US005183957A

United States Patent [19]

Weldon et al.

[11] Patent Number: 5,183,957

[45] Date of Patent: * Feb. 2, 1993

[54] METHOD AND CONSTRUCTION FOR CONTROL OF CURRENT DISTRIBUTION IN RAILGUN ARMATURES

[75] Inventors: William F. Weldon; Herbert H. Woodson; Glen C. Long, all of Austin, Tex.

[73] Assignee: Board of Regents, The University of Texas System, Austin, Tex.

[ * ] Notice: The portion of the term of this patent subsequent to Sep. 4, 2007 has been disclaimed.

[21] Appl. No.: 509,057

[22] Filed: Apr. 13, 1990

Related U.S. Application Data

[63] Continuation of Ser. No. 203,556, Jun. 1, 1988, Pat. No. 4,953,441, which is a continuation of Ser. No. 885,915, Jul. 15, 1986, abandoned.

[51] Int. Cl.[5] ..... F41B 6/00

[52] U.S. Cl. ..... 89/8; 124/3; 174/126.2; 174/133 B

[58] Field of Search ..... 89/8; 124/3; 174/126.2, 174/133 R, 133 B; 191/22 DM, 29 DM, 33 PM; 310/12; 318/38, 135

[56] References Cited

U.S. PATENT DOCUMENTS

| | | | |
|---|---|---|---|
| H357 | 11/1987 | Howland et al. | 89/8 |
| 1,679,518 | 9/1924 | Fowle | 174/133 R |
| 3,126,789 | 3/1964 | Meyer | 89/8 |
| 3,619,812 | 11/1971 | Asmus | 372/56 |
| 3,878,409 | 4/1975 | Gill et al. | 89/8 |
| 3,918,557 | 11/1975 | Ross | 191/59.1 |
| 4,355,561 | 10/1982 | Kemeny et al. | 89/8 |
| 4,369,691 | 1/1983 | Baeher, Jr. et al. | 89/8 |
| 4,423,662 | 1/1984 | McAllister | 89/8 |
| 4,459,504 | 7/1984 | Weldon et al. | 310/243 |
| 4,467,696 | 9/1984 | McNab et al. | 89/8 |
| 4,485,720 | 12/1984 | Kemeny | 89/8 |
| 4,694,729 | 9/1987 | Hall | 89/8 |
| 4,953,441 | 9/1990 | Weldon et al. | 89/8 |

OTHER PUBLICATIONS

Kolm et al, "An Alternative Launching Medium", IEEE Spectrum Applications, 1982, pp. 30–36.

Bedford, A. J. "Rail Damage and Armature Parameters for Different Railgun Rail Materials", IEEE Transactions on Magnetics, vol. Mag. 20, No. 2, Mar. 1984, pp. 352–355.

Hawke, R. and Scudder, J. "Magnetic Propulsion Railguns: Their Design and Capabilities," *Lawrence Livermore Laboratory,* paper prepared for the Second International Conference on Magagauss Magnetic Field Generation and Related Topics, May 29 to Jun. 1, 1979, Washington, D.C.

Rashleigh, S. and Marshall, R. "Electromagnetic Acceleration of Macro Particles to High Velocities," 49 *J. Appl. Phys.,* 2540 (Apr. 1978).

*Primary Examiner*—Stephen C. Bentley

*Attorney, Agent, or Firm*—Arnold, White & Durkee

[57] ABSTRACT

An electromagnetic railgun having a layer of low conductivity material along the rails to interface with the armature as the armature is propelled along the rails. The low conductivity material has been found to permit rapid current penetration between the layer and armature, thereby inhibiting undersirable high current density formation along the trailing edge of the armature. Advantageously, inhibiting the high current density formation permits use of a solid armature at velocities exceeding on kilometer per second. Preferably, the layer is composed of graphite or a graphite/copper mixture. A layer of copper or other high conductivity material is preferably laminated to the low conductivity graphite layer to reduce the overall railgun circuit resistance. In the preferred embodiment, the layer of low conductivity material increases in thickness from the breech to the muzzle to decrease railgun circuit resistance.

2 Claims, 2 Drawing Sheets

METHOD AND CONSTRUCTION FOR CONTROL OF CURRENT DISTRIBUTION IN RAILGUN ARMATURES

The United States government may have rights in this invention pursuant to funding arrangements with the Department of Defense.

This is a continuation of application Ser. No. 203,556, filed Jun. 1, 1988, now U.S. Pat. No. 4,953,441 which in turn is a continuation of Ser. No. 885,915, filed Jul. 15, 1986, now abandoned.

BACKGROUND OF THE INVENTION

1. Field of the Invention

This invention relates to an improvement in electromagnetic railgun construction which substantially improves railgun performance and permits use of a solid armature. In particular, it relates to a railgun having a layer of low conductivity material, such as graphite, along the railgun bore which inhibits the concentration of current density along the interface of the rail and armature.

2. Description of the Related Art

Thermodynamic guns are widely used and generally understood in a broad context. In an ordinary thermodynamic gun, a propellant burns to generate high pressure gas that pushes a projectile down a bore. While thermodynamic guns are used in many applications besides weapons—for example scientific and industrial applications—their use is somewhat limited because of the maximum velocities attainable. Thus, physical limitations limit the projectile from such thermodynamic guns from reaching velocities much greater than one kilometer per second.

Electromagnetic railguns have been widely investigated since World War II as an alternative to thermodynamic guns because of the possibilities of achieving projectile hypervelocities (greater than one kilometer per second).

The early electromagnetic railguns incorporated a solid armature which was propelled between the rails by the electromagnetic force generated by the current flow through the armature and the rails. However, it was soon found that at high speeds around one kilometer per second, the rails and armature were substantially damaged, possibly as a result of ohmic heating and/or internal forces. Further, increases in current flow tended to only increase rail and armature gouging without an increase in armature velocity. Thus, armature velocities in excess of one kilometer per second were not practically attainable for railguns using solid armatures.

In the early 1970's, R. A. Marshall, J. P. Barber, and others at the Australian National University, Canberra, Australia, developed railguns using plasma armatures which could obtain hypervelocities and could make efficient use of high current, pulsed power supplies, such as compulsators and homopolar generators. Plasma armature railguns are generally described in S. C. Rashleigh and R. A. Marshall, "Electromagnetic Acceleration of Macroparticles to High Velocities," 49 *J. App. Phys.* 2540 (Apr. 1978) (incorporated herein by reference). Such power supplies are broadly illustrated in U.S. Pat. Nos. 4,200,831; 4,459,504; 4,246,507; and U.S. patent application Ser. No. 06/689,868 issued U.S. Pat. No. 4.026,286 (incorporated herein by reference).

In recent years, additional research has revealed numerous problems associated with very high current plasma armatures. For example, at the high currents necessary to obtain hypervelocities, rail errosion has been a significant problem which essentially relegates the railgun to a one or two shot application. Additionally, plasma armature type railguns require a sealed bore (open only at the muzzle) capable of withstanding the substantial electromagnetic forces generated; the gaskets, seals, and insulator material associated with such bores have proven a significant problem. For example, in addition to rail and insulator damage, metallic deposits often adhere to the insulator surfaces after firing, causing arcing problems during subsequent firing.

In addition to the practical difficulties of plasma-type electromagnetic railguns, several fundamental problems have become of increasing concern. For example, at the typical working currents in question, the dissipative armature voltage drop is an order of magnitude greater than desirable. Perhaps more fundamentally, plasma armatures are designed to accelerate a projectile using base pressures. Base pressure acceleration (such as also used in thermodynamic guns) places severe design limits on the projectile. For example, a projectile must be able to withstand the extreme temperature and pressures exerted at its base by the driving plasma. Such projectile design limits are removed and gun efficiency substantially improved if a solid armature is used as the projectile. A solid armature/projectile offers the prospect of acceleration by body forces on the armature/projectile.

While a solid armature railgun avoids many of the problems associated with plasma armatures—e.g. substantial dissipative armature voltage drop and base pressure acceleration—attempts to obtain hypervelocities with solid armature railguns have proven unsuccessful. Thus, it would a significant advance in the art if a railgun were devised which could utilize a solid armature and operate at velocities substantially in excess of one kilometer per second.

SUMMARY OF THE INVENTION

The problems outlined above are largely solved by the railgun of the present invention using a rail construction which permits projectile acceleration to hypervelocities (greater than one kilometer per second). The railgun construction hereof is compatible with solid armatures for propelling the solid armatures at velocities exceeding one kilometer per second without the significant rail damage associated with past solid armature railguns. Use of a solid armature in the railgun of the present invention not only eliminates the dissipative voltage drop and construction problems associated with plasma armatures, but permits body force acceleration of the solid armature, allowing optimum projectile design.

Analysis of the operation of past solid armature railguns led to the conclusion that the inability to obtain acceptable railgun performance was associated with the extremely high current densities at the interface of the rail and armature at velocities approaching one kilometer per second. The concentration of current density not only limited the amount of current flow through the armature, but also led to rail gouging. This high current density problem was intuitively addressed by changing the construction and composition of the solid armature in an attempt to alleviate the current density problems. It was found that the solid armature construction and composition have only minor effect on the current density problem. Unexpectedly, it was discovered that the rail construction and composition had a significant effect on reducing the current density problem.

Broadly speaking, the railgun of the present invention includes an electrical power supply and a pair of spaced rails having an armature received therebetween for propulsion along the rails when current flows through the rails and armature. A layer of low conductivity material is disposed along the length of the bore for permitting rapid current penetration between the armature and layer to inhibit the concentration of current density along the trailing end of the armature as it is propelled along the bore. Preferably, each rail has a layer of the low conductivity material adjacent the bore. Graphite, or a graphite/copper mixture has been found to be a particularly suitable material for use as the low conductivity layer, with the graphite providing the added advantage of reducing frictional forces between the armature and rails. Preferably, a layer of copper or other high conductivity material overlies the low conductivity layer to reduce the overall railgun circuit resistance. While the railgun construction of the present invention may be useful in plasma-type armature railguns, it is anticipated that the railgun of the present invention will be widely used in solid armature type railguns.

DESCRIPTION OF THE PREFERRED EMBODIMENTS

Figure 1:
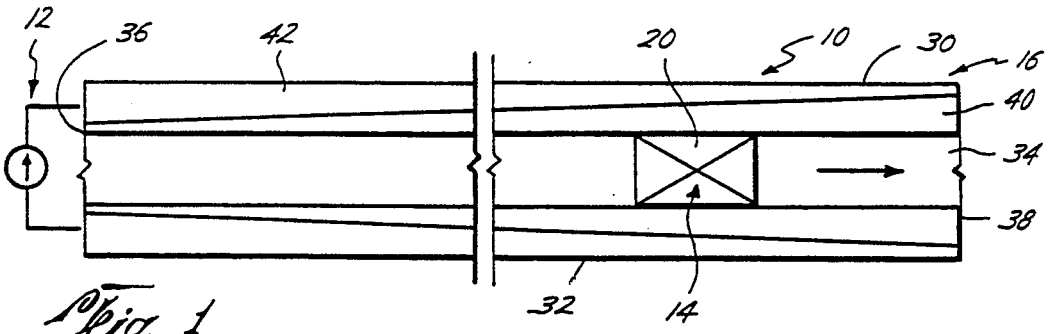
FIG. 1 is a fragmentary, sectional, schematic view of a railgun in accordance with the present invention.

Turning now to the drawings, FIG. 1 diagrammatically illustrates a railgun 10 in accordance with the present invention. Broadly speaking, the railgun 10 includes power supply 12, armature means 14, and rail mechanism 16. The power supply 12 is preferably a homopolar generator, it being understood that other types of energy stores may be appropriate in certain applications. For example, a compulsator or different types of capacitor-based distributed energy store systems. A specific type of homopolar generator useful as a power supply 12 in a railgun 10 is described in U.S. Pat. No. 4,459,504, which is incorporated herein by reference. Because the railgun 10 of the present invention is interested in hypervelocity operation, the power supply 12 should generally be capable of generating at least 500 kiloamps.

The armature means 14 is preferably a solid armature 20 as illustrated in the drawings. Although a plasma armature might be incorporated in the railgun 10 of the present invention, the solid armature 20 is believed to be of superior performance characteristics when compared with plasma armature type railguns. In the railgun 10 of the present invention, the solid armature 20 also functions as a projectile, and therefore may be appropriately shaped depending upon the application of the railgun—i.e. aerodynamic considerations, penetrating ability, length/diameter ratio, etc.

The rail mechanism 16 broadly includes a pair of spaced, juxtaposed, elongated rails 30, 32 defining a bore 34 therebetween. Preferably, the rails 30, 32 each present a smooth, rectilinear surface defining the bore 34 and are in parallel relationship to present a bore 34 of uniform dimensions. In the preferred embodiment, the rails 30, 32 comprise plate-like structures to present a square bore 34, it being understood that the rails 30, 32 could be arcuate surfaces to define an ovular or circular bore.

The rail mechanism 16 presents a breech 36 and a muzzle 38, with the power supply 12 connected to the rails 30, 32 at the breech 36. Advantageously, the solid armature 20 is received in the bore 34 for slidable movement from the breech 36 to the muzzle 38 in the direction of the arrow shown in FIGS. 1 and 2.

Each rail 30, 32 is bifurcated into a low conductivity layer 40 and a high conductivity layer 42. In the preferred embodiment of FIG. 1, the low conductivity layer is graphite and increases in thickness from the breech 36 to the muzzle 38. In the embodiment of FIG. 1, the high conductivity layer is composed of copper and decreases in thickness from the breech 36 to the muzzle 38. In experimentation, a graphite-copper mixture has been found alternatively suitable for use as the low conductivity layer 40. The layers 40, 42 are operatively connected using conventional laminating or bonding techniques (e.g. oven brazing).

Figure 2:
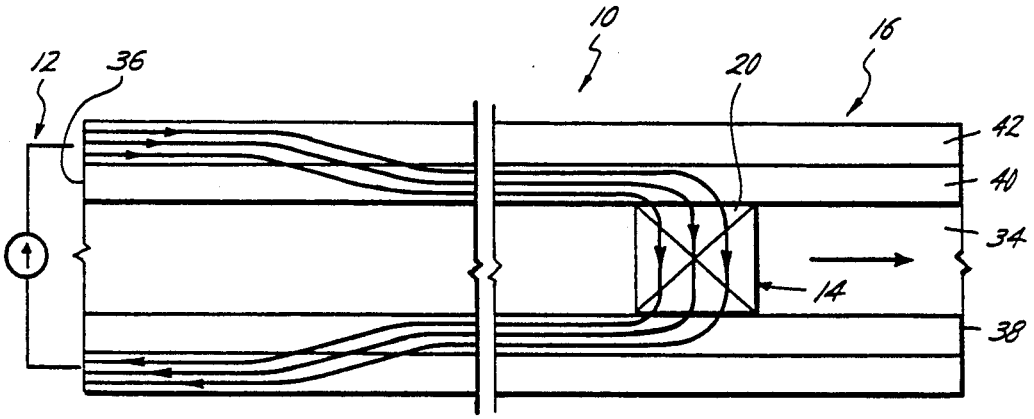
FIG. 2 is a fragmentary, sectional, schematic view similar to FIG. 1, which shows an alternative embodiment of the railgun construction.

In FIG. 2, an alternative embodiment is illustrated which differs from the preferred embodiment of FIG. 1 in the dimension of the layers 40, 42. In FIG. 2, the layers 40, 42 are of constant thickness from the breech 36 to the muzzle 38. While such a construction is slightly easier to fabricate, it appears that the embodiment of FIG. 2 does not yield as efficient a railgun 10 as the embodiment of FIG. 1. In FIG. 2, the exact thickness of each layer 40, 42 from the breech 36 to the muzzle 38 is dependent upon the intended application and the intended design specification for projectile velocity, conductivity, current permeability, etc.

OPERATION

Operation of the railgun 10 in accordance with the present invention is similar to operation of known railguns with the superior operating characteristics resulting from the construction of the rail mechanisms 16. Broadly speaking (see FIG. 2), a pulsed power surge emanates from power supply 12 (e.g. homopolar generator or compulsator) into rail 30. Current flows through the rail 30, through the armature 20, and into the other rail 32 to complete the railgun circuit. The current flowing in opposite directions in the two parallel rails 30, 32 creates an intense magnetic field (B) between the rails. The interaction of the current (J) in the armature 20 with this orthogonal magnetic field B results in a Lorentz force which accelerates the armature 20 down the railgun 10. The Lorentz force drives the solid armature 20 through the bore 34 from the breech 36 to the muzzle 38. In the embodiments of FIGS. 1 and 2 where a solid armature 20 is used, the solid armature increases in velocity until it is propelled from the muzzle 38. That is, that solid armature 20 also acts as a projectile and is driven with body forces. In the railgun 10 of the present invention, the muzzle velocity of the armature/projectile 20 well exceeds one kilometer per second without unacceptable rail damage.

Figure 5:
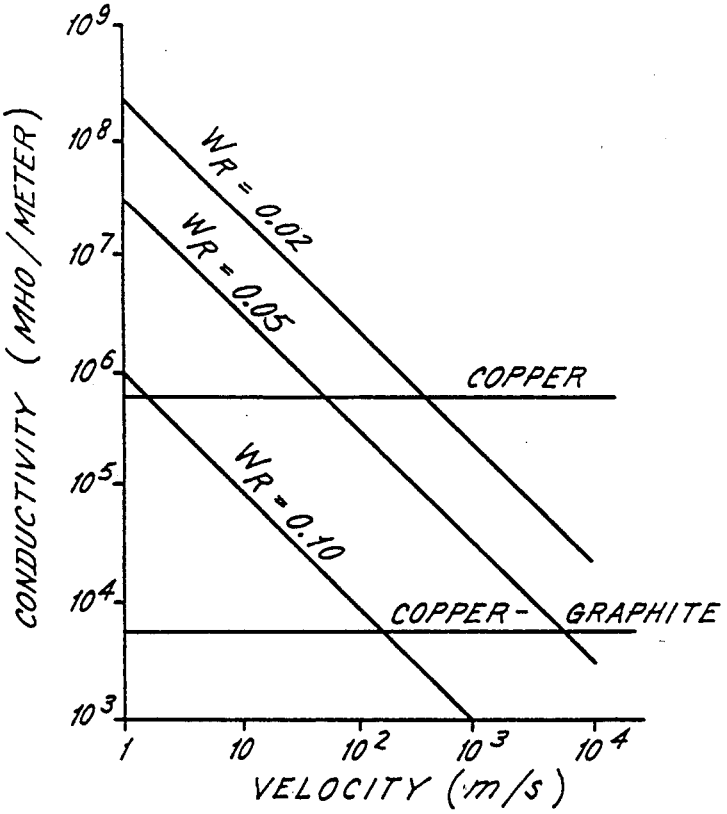
FIG. 5 is a graph which illustrates the theoretical suitability of different materials for the low conductivity layer of the present invention at different armature velocities.
Figure 3:
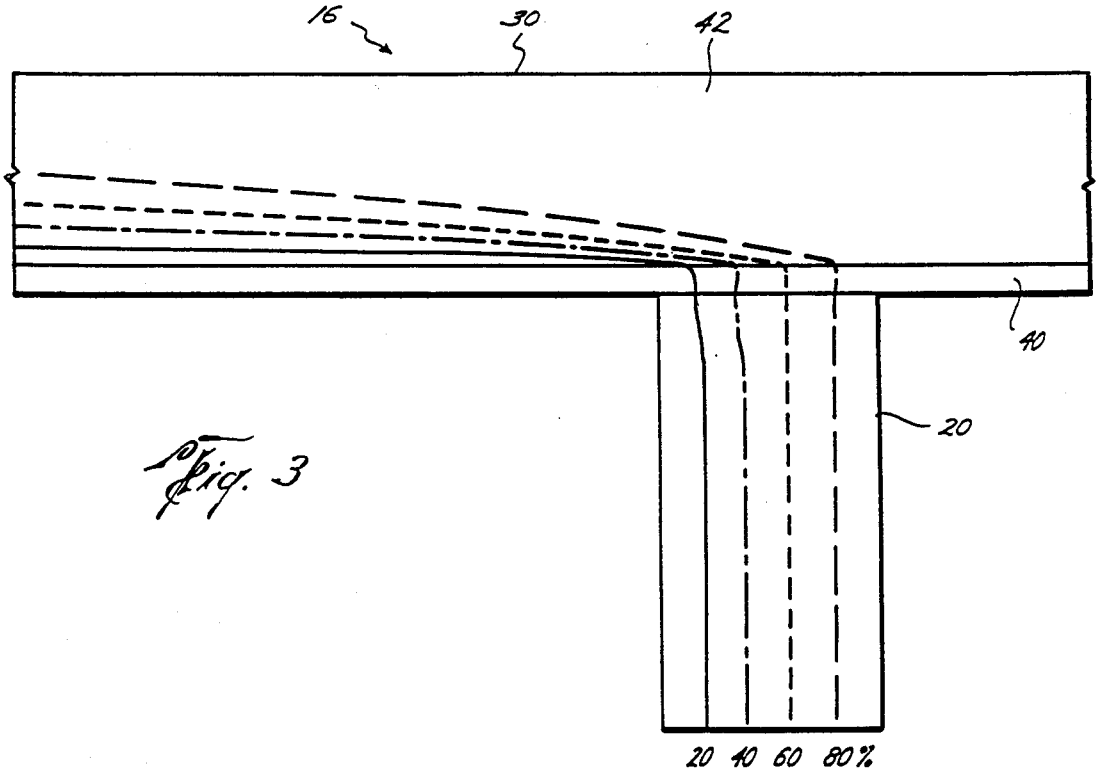
FIG. 3 is an enlarged, fragmentary, sectional view showing the current density distribution between a solid armature and a rail in accordance with the present invention with the armature propelled at 100 meters per second.
Figure 4:
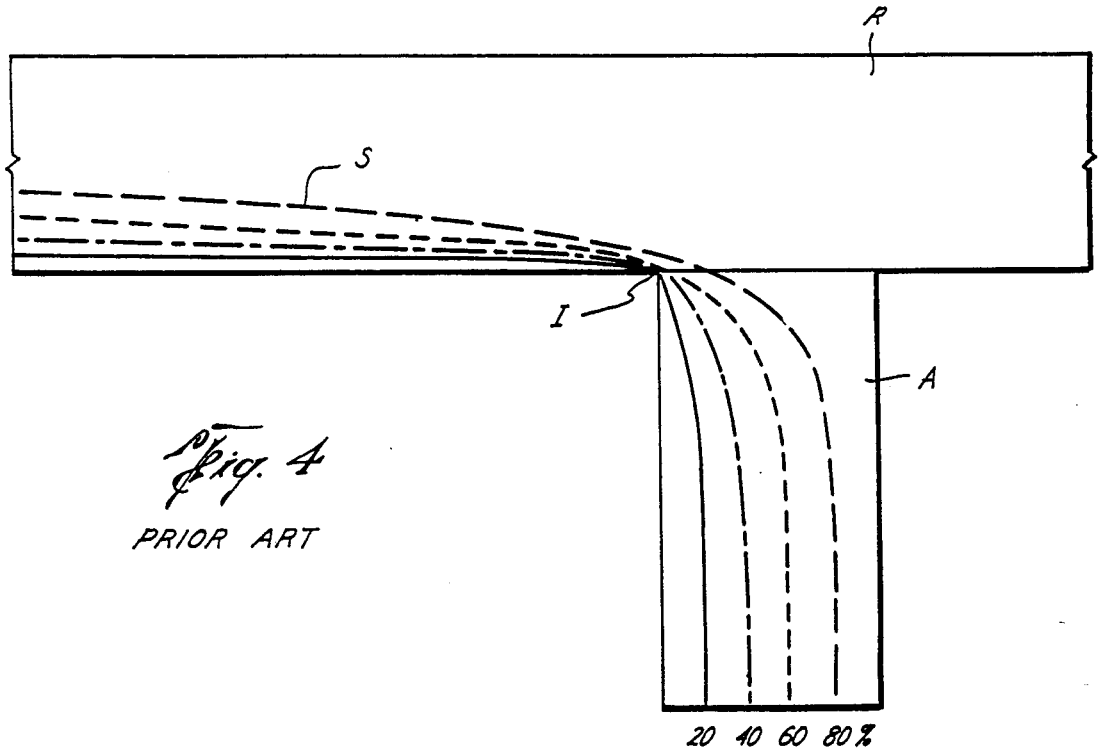
Fig. 4 PRIOR ART
FIG. 4 is a prior art Figure similar to FIG. 3, showing the current density distribution of a conventional solid armature type railgun with the armature propelled at 100 meters per second.

Without being bound by theory, Applicant believes FIGS. 3–5 illustrate the current density problem with conventional solid armature railguns, and the solution to those problems offered by railgun 10 in accordance with the present invention. Turning to prior art FIG. 4, an armature A is propelled along rail R at a nominal velocity of 100 meters per second. In FIG. 4, the rail R width is 1.00 centimeter, while the armature width is 1.00 centimeter and has a halflength of 2.00 centimeters. The rail R is composed of a single layer of copper. The current streamlines S show the current distribution through the rail R, armature A, and rail/armature interface I for the percentages labeled in the drawing. That is, the current streamlines in the armature A of FIG. 4 read 20%–80% (left to right) of the total current.

From FIG. 4, it can be seen that even at the relatively low speed of armature A of 100 meters per second, the current is concentrated at the trailing edge of armature A along the interface I. Such extremely high current densities can result in melting of the rail R and armature A. It is theorized that at concentrated current densities the ohmic heating along the interface I welds portions of the armature A and rail R and then breaks; this successive weld/break causing severe rail gouging.

The driving force on the armature A is roughly equal to:

$$F=\tfrac{1}{2} L' I^2$$

where L' is the inductance per unit length of the gun rails and I is the current.

Thus, because the driving force of the armature is a function of the square of the current, the restriction of current caused by concentrated current density has a substantial effect upon the driving force available. Of course, as velocity increases, current density becomes more concentrated along the trailing edge of the interface I. Therefore, the current density problem not only damages the rails, but also fundamentally limits the amount of driving force, and hence velocity, physically possible.

Before the present invention, attempts were made to delay the current density concentration at the rear of the armature A by changing the properties of the armature. Although such an approach appears intuitively correct, these attempts were largely unsuccessful. It is readily seen that a uniform current distribution across the entire interface I is ideal.

It is theorized that for a uniform current distribution, the current must penetrate between the rail and armature in the time required for the armature to pass a given point. Thus, the current injected from the front of the armature into the rail (or rail into armature) must be fully penetrated by the time the back of the armature passes the point. The time (t) required for the armature to pass a given point on the rail is:

$$t=l_a/v$$

where $l_a$ is armature length and v is the armature velocity at that point.

The depth (δ) which the current can penetrate into the rail during time (t) is:

$$\delta=\sqrt{\frac{4t}{\pi\mu\sigma}}$$

where μ is the magnetic permeability of the rail material and σ is the conductivity of the rail material.

It is apparent that the depth (δ) which the current can penetrate in time (t) is the value of interest in choosing a rail material. Although the penetration depth (δ) is a function of conductivity (σ) and permeability (μ), for nonferromagnetic materials the permeability (μ) is nearly constant. Therefore, conductivity (σ) becomes of prime interest in determining the suitability of a rail material.

By setting δ equal to the rail thickness ($W_R$) the rail conductivity necessary to allow the current to fully penetrate in the required time can be found. For nonferromagnetic materials ($\mu=\mu_o$):

$$\sigma=\frac{4l_a}{\pi\mu_0 v W_R^2}$$

FIG. 5 is a plot of conductivity as a function of velocity for a railgun having a 10 centimeter square bore, a solid armature with an armature length (1*a*) to bore ratio of 1, and different rail thickness ($W_R$) values as indicated in FIG. 5. From FIG. 5, it can be seen that for rails of reasonable thickness, copper becomes unsuitable for rail material at armature velocities well below one kilometer per second. It is seen from FIG. 5 that copper/graphite is a suitable material at velocities at least an order of magnitude greater than copper, and it has been found that a solid graphite rail is suitable for even higher armature velocities. It should be readily appreciated that graphite has the additional advantage of reducing the friction between the armature 20 and rails 30, 32 as the armature 20 is propelled through the bore 34. The graphite mixture has also been found an acceptable rail material in view of the effects of current passage on the wear between armature 20 and the rails 30, 32.

The use of the low conductivity layers 40 on the rails 30, 32 has been found to address the problem of current distribution in solid armature railguns and provides an attractive sliding interface between the armature and rails. However, such low conductivity layers 40 increase the resistance in the overall railgun circuit, at least partially offsetting the efficiency gained achieved by use of the solid armature 20 over plasma armatures. A partial solution to this increased resistance problem is laminating the low conductivity layer 40 (such as graphite) to a high conductivity layer 42 (such as copper) whereby the low conductivity layer 40 controls current distribution in the vicinity of the armature and the high conductivity layer 42 transports the current in the fully penetrated portion of the rails 30, 32 behind the armature 20 (see FIGS. 2 and 3).

In the preferred embodiment of FIG. 1, the thickness of the layer 40 is appropriately sized along the length of the railgun 10 according to expected armature velocity at a given location. Thus, current penetration is greatest at the muzzle 38 and accordingly the layer 40 is thickest in the region of the muzzle 38. Conversely, current penetration is not as great a problem in the region of the breech 36, and accordingly the low conductivity layer 40 can be relatively thin adjacent the breech 36. Conveniently, the thickness of the high conductivity layer 42 is the reverse of layer 40, and advantageously optimizes current transport. That is, current transport is greatest, and the thickness of the layer 42 greatest, adjacent the breech 36, while current transport is not as problematic, and the layer 42 relatively thin, adjacent the muzzle 38.

FIG. 3 illustrates the current streamlines in a railgun 10 in accordance with the present invention with the armature 20 depicted at a nominal velocity of 100 meters per second. In FIG. 3, the rail mechanism 16 is appropriately sized for comparison with FIG. 4; that is, the rail 30 width is 1.00 centimeter, the armature width is 1.00 centimeter, and the armature halflength is 2.00 centimeters. The width of the layer 40 is constant at 0.125 centimeters of graphite, while the width of layer 42 is 0.875 centimeters of copper. As is readily appreciated from FIG. 3, the current distribution is nearly uniform (near optimum) allowing the prospects of substantially higher current flow through the railgun 10, with the concommitmant increase in driving force on the armature ($F=\frac{1}{2} L' I^2$). This increase in driving force results in a substantial increase in the velocities attainable of the armature/projectile 20 from the railgun 10, exceeding one kilometer per second. Because the current density is nearly uniform, ohmic heating and rail damage is minimized. Although at velocities exceeding 1 km/sec the current density begins to concentrate along the trailing edge of the armature, this concentration is substantially delayed when compared with prior art (FIG. 4) railguns. Advantageously, the penetrating ability of the armature/projectile 20 is similarly greatly enhanced with the increase in velocity ($E=\frac{1}{2} mV^2$).

The railgun 10 in accordance with the present invention appears to yield acceptable railgun performance characteristics at solid armature velocities significantly greater than one kilometer per second. Thus, railgun 10 largely avoids the problems associated with past solid armature railguns. Thus, higher armature velocities and a more uniform current density is achieved, with little or no damage to the armature and rails at velocities in excess of one kilometer per second. Further, the preferred embodiment of the railgun 10 of the present invention utilizes a solid armature 20 which offers many advantages over plasma armature type railguns. That is, the solid armature type railgun 10 avoids the dissipative of voltage drop across the plasma armature while providing a body force electromagnetic drive on the armature/projectile 20. The body force drive of the railgun 10 avoids the base pressure driving force problems associated with plasma type railguns and thermodynamic guns. Further, the solid armature type railgun 10 avoids the rail gouging problems, and deposit and arcing problems associated with plasma type railguns. While the railgun construction of the present invention can incorporate a plasma armature without departing from the scope of the present invention, it is anticipated that in most applications the railgun 10 will incorporate a solid armature.

In summary, the railgun 10 in accordance with the present invention offers desirable railgun performance characteristics at solid armature velocity significantly exceeding one kilometer per second.

We claim:

1. An electromagnetic railgun comprising:

an electrical power supply;

solid armature means having a leading edge and a trailing edge; and rail means having a pair of spaced, juxtaposed rails defining an elongated bore therebetween and operable for receiving the solid armature means along the length of the bore, the rail means being operably connected to the power supply to provide a current flow path through one of the rails, and into the other rail to propel the solid armature means along the bore in the direction of the leading edge when power is supplied, the rail means including a layer of a copper and graphite mixture extending along substantially the entire length of the bore for permitting rapid current penetration between the solid armature and layer to inhibit the concentration of current density and eliminate arcing in the region of the trailing end of the solid armature means as the solid armature means is propelled along the bore, the rail means including a layer of high conductivity material adjacent the layer of copper and graphite mixture and extending substantially the length thereof, the high conductivity material having a conductivity greater than the conductivity of the copper and graphite mixture.

2. In an electromagnetic railgun having a pair of spaced, generally parallel, electrically conductive rails defining a bore therebetween, and a solid armature received in the bore for propulsion along the bore when current flows through the armature and through the rails, the improvement comprising:

a layer of a copper and graphite mixture on at least one of the rails adjacent the bore and extending the entire length of the bore along the rail, the copper and graphite mixture having a conductivity less than copper for inhibiting a high current density from developing and for eliminating arcing along the interface of the layer and armature as the armature is propelled along the bore.

* * * * *

UNITED STATES PATENT AND TRADEMARK OFFICE

CERTIFICATE OF CORRECTION

PATENT NO. : 5,183,957

DATED : February 2, 1993

INVENTOR(S) : William F. Weldon, Herbert H. Woodson and Glen C. Long

It is certified that error appears in the above-identified patent and that said Letters Patent is hereby corrected as shown below:

Column 8, line 22, claim 1, after "...rails," insert --through the solid armature means,--

Signed and Sealed this

Seventh Day of December, 1993

*Attest:*

Bruce Lehman

BRUCE LEHMAN

*Attesting Officer*

*Commissioner of Patents and Trademarks*